US005413343A

United States Patent [19]

Foley et al.

[11] Patent Number: 5,413,343

[45] Date of Patent: May 9, 1995

[54] REDEMPTION COUPON DISPENSING COIN-OR-BILL OPERATED MINI GOLF GAME

[75] Inventors: Thomas P. Foley; Robert T. Foley, both of Severna Park; Albert C. Pritchard, Harwood, all of Md.

[73] Assignee: Embark, Inc., Severna Park, Md.

[21] Appl. No.: 138,040

[22] Filed: Oct. 19, 1993

[51] Int. Cl.[6] ..... A63B 69/36

[52] U.S. Cl. ..... 273/176 B; 273/176 R; 273/176 K

[58] Field of Search ..... 273/176, 352, 32 R, 273/34 R, 180, 178 B, 181 R, 182 R, 182 A, 181 A, 181 D, 35 R

[56] References Cited

U.S. PATENT DOCUMENTS

| | | | |
|---|---|---|---|
| 1,221,803 | 4/1917 | Johnston . | |
| 2,010,213 | 8/1935 | Bergoffen . | |
| 2,251,305 | 8/1937 | Tarvox . | |
| 2,326,859 | 8/1943 | Hoover | 273/35 L |
| 2,704,212 | 3/1955 | Dunseith . | |
| 2,926,915 | 3/1960 | Johns . | |
| 3,011,791 | 12/1961 | Page . | |
| 3,184,239 | 5/1965 | Heuser . | |
| 3,602,506 | 8/1971 | Gentiluomo . | |
| 3,861,680 | 1/1975 | Mowrer | 273/176 K |
| 3,885,795 | 5/1975 | Brewer . | |
| 4,240,637 | 12/1980 | Cross et al. . | |
| 4,767,117 | 8/1988 | Maio . | |

*Primary Examiner*—Mark S. Graham
*Attorney, Agent, or Firm*—Browdy and Neimark

[57] ABSTRACT

This invention is directed to an automated mini-golf game having a plurality of mini-golf holes which each have a tee area, a fairway or putting green and at least one target hole. The final mini-golf hole of the game has a coin and bill acceptor for delivering a golf ball to a player when actuated, a target area with target holes at an elevated end of a ramp, and a switch and dispensing device for identifying which target hole through which a golf ball has been putted, and thereafter dispensing redemption coupons corresponding to such hole. The final hole also has a set of racks on its housing to hold scorecards, pencils and golf clubs, thereby permitting an entire game to be played sequentially by a multitude of players without an on-site attendant.

2 Claims, 8 Drawing Sheets

REDEMPTION COUPON DISPENSING COIN-OR-BILL OPERATED MINI GOLF GAME

BACKGROUND OF THE INVENTION

1. Field of the Invention

The invention is drawn to a mini golf game having a unit which accepts coins or currency to dispense golf ball automatically without the need for an attendant, and at the conclusion of play retains the balls for future redispensing. The golf course contains the plurality of putting holes which have fairways that can be distorted for the amusement of the player. The mini golf course may be used with as little as two holes for a small area location, or it can be used with any number of putting holes. A redemption coupon dispenser is automatically energized at the conclusion of play to dispense redemption coupons according to the points the player scores on the last putting hole.

2. Background of the Prior Art

Mini-golf has been in use for many years, with courses of a few to 18 or 3 holes. The last hole of the course almost invariably retains the ball for later collection by an attendant, who also provides the ball at the start of play. This last hole generally contains a target of some type that the player putts the ball into. The present invention offers an automated coin-or-bill operated mini golf game, not requiring an attendant while rewarding the player for high scores on the last hole by dispensing redemption coupons. Coin input mechanisms and bill acceptors are readily available on the market, as are battery-or-power supply-operated redemption ticket dispensers.

SUMMARY OF THE INVENTION

An automated Mini-Golf game is activated by a player inserting a required number of coins or bills into a combined golf ball dispenser and last hole unit, which dispenses one golf ball for each activation. The player selects a club from the rack attached to the unit, and obtains a scorecard and pencil from another attached rack. The mini-golf game is then played through as many golf holes a desired, ending at the last hole, in the combined golf ball dispenser and the last hole unit. The player tees the ball, putts it into the target in an attempt to score the largest points possible. The ball is then retained in the unit, for further later dispensing to another player. Redemption coupons in quantities relative to the score received on this last hole are automatically dispensed to the player.

DESCRIPTION OF THE PREFERRED EMBODIMENT

Figure 1:
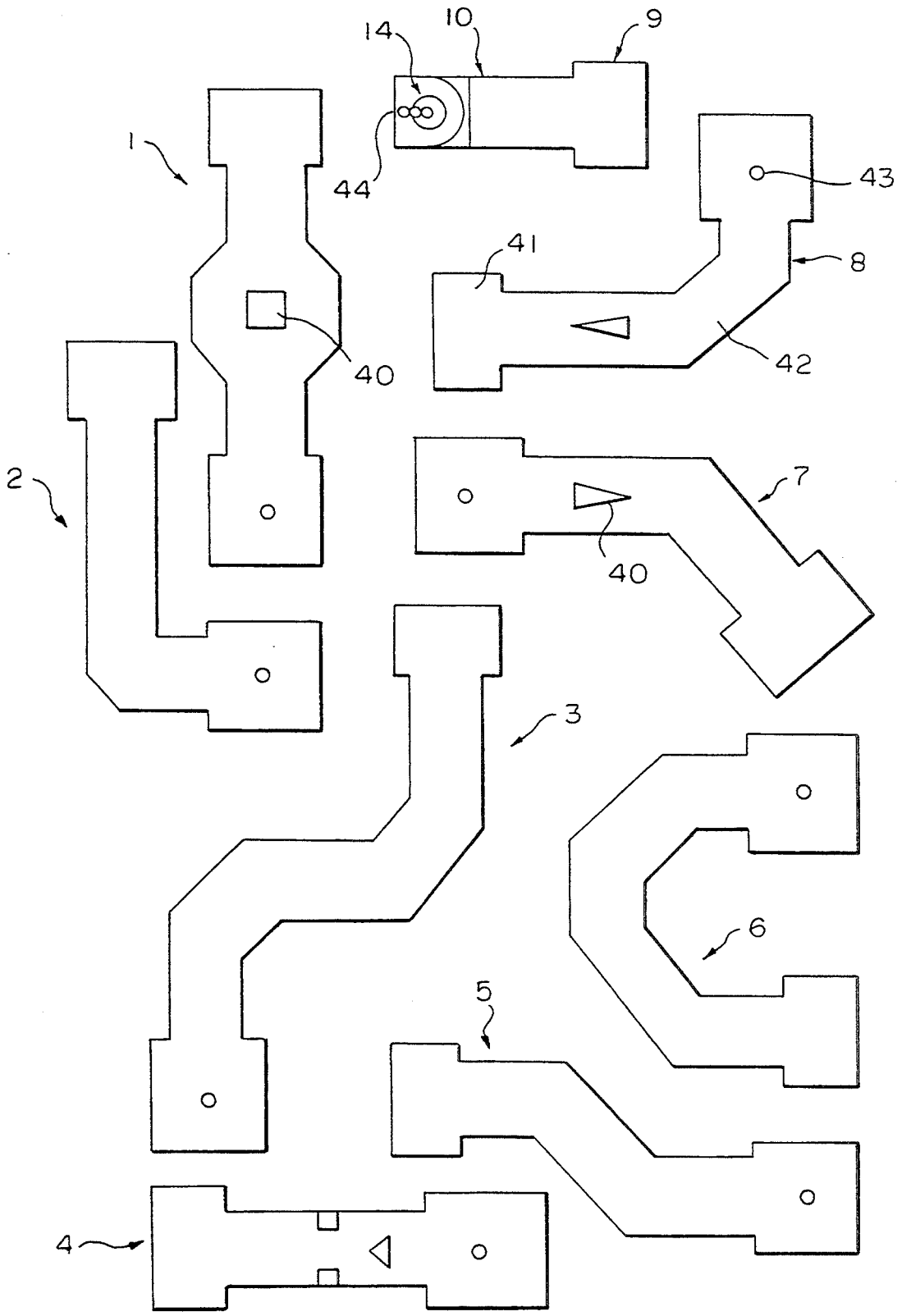
FIG. 1 is a plan view of the mini-golf course according to the invention.

A plan view of a nine-hole mini-golf course according to the invention is illustrated in FIG. 1. Coins and/or bills are inserted into the front panel 18 of a golf ball dispenser and last hole unit 10 to activate a ball delivery mechanism. The nine-hole course is then started at hole #1, the tee area of which is located adjacent to the ball delivery mechanism of unit 10. Golf putters and score cards and pencils are obtained from racks on the front panel 18 of unit 10, and the entire course is played progressively. Tee areas of each hole are designated 1 through 9 on the drawing. Various contours are shown as examples, as are obstacles 40 which are shown as dark shaded areas. As the player putts from the #9 tee, he or she putts the ball into a target area 14 on unit 10, and the proficiency of the putt determines the number of redemption coupons dispensed by unit 10.

Figure 2:
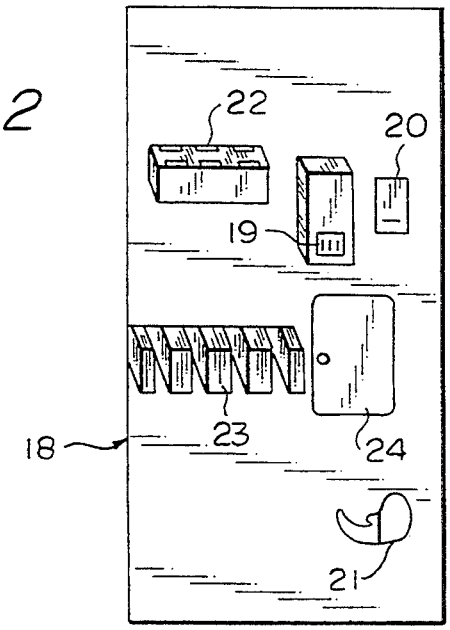
FIG. 2 is a view of the front panel of the golf ball dispenser and last hole unit used in the mini-golf course of FIG. 1.
Figure 3:
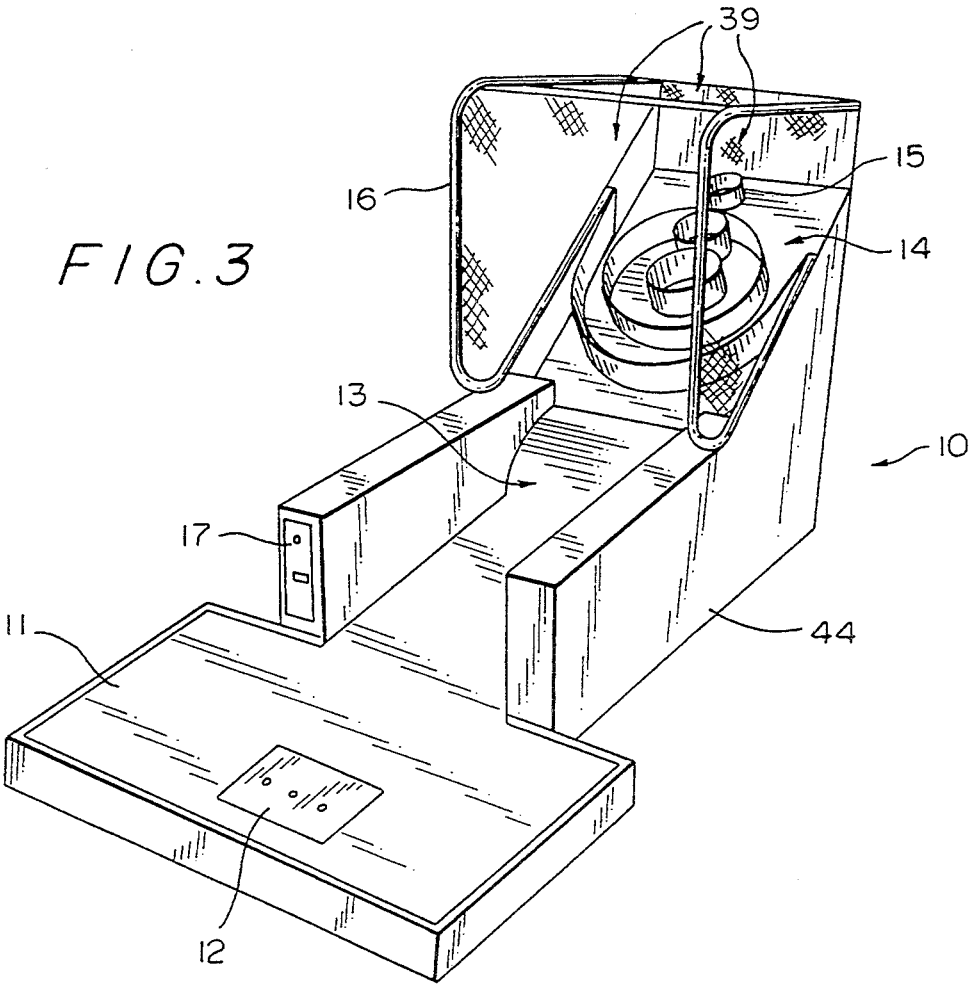
FIG. 3 is a perspective rear/right quarter view of the golf ball dispenser and last hole unit of FIG. 2 showing the tee, ramp, target, retaining screening and redemption coupon dispenser.
Figure 4:
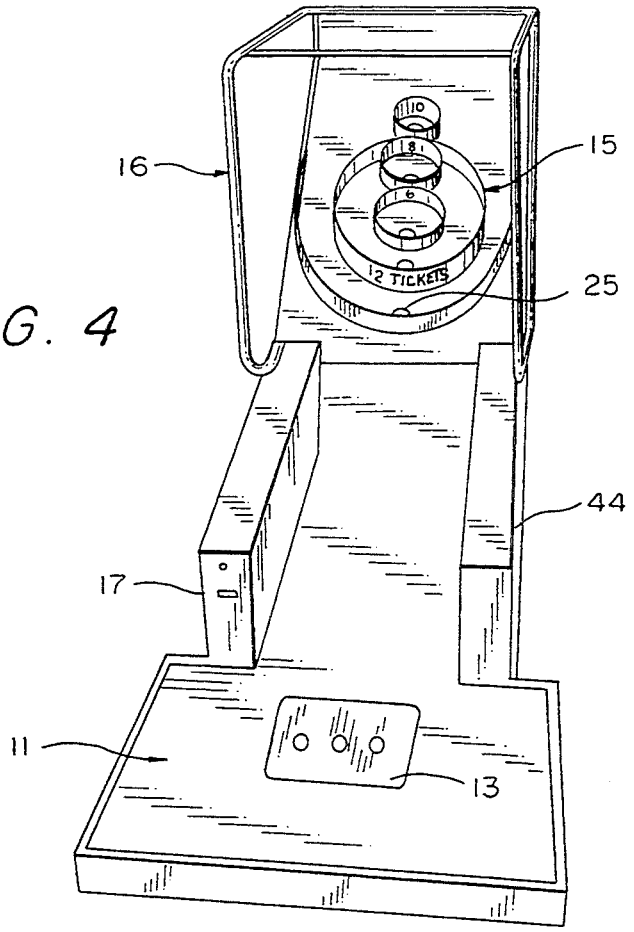
FIG. 4 is a rear perspective of the golf ball dispenser and last hole unit of FIG. 3, more clearly showing the target area, labeled for quantities of redemption coupons to be won for scoring.

The combination ball dispenser and final hole unit 10, is shown in greater detail in FIGS. 2, 3 and 4. As shown unit 10 is a combination of an automated golf ball dispenser for the mini-golf game and a ramp and target 14 at the last hole which also dispenses redemption coupons. When playing the final hole, the player stands in the tee area 11, places his golf ball on the mat 12, and uses his golf putter to strike the golf ball with sufficient force to propel it up the ramp 13 over hump 26 onto the target area 14, attempting to land the ball in the most difficult of the target holes 25, or in any of the lesser scoring holes below. A frame 16 supports a netting or wire screen 39 to contain the golf ball if struck erratically or with too much force. As a result of falling through one of the target holes, a redemption coupon dispenser 17 is energized to deliver coupons to the player as the ball is retained within the body of the unit 10 for later replay.

FIG. 2 shows the front panel 18 of the final hole unit 10 of the mini-golf game, which serves as the front of the housing 44 and mount for the ball, club, scorecard and pencil dispensing elements discussed below. A prospective player inserts the required number of coins into coin acceptor 19, or the required bill(s) into bill acceptor 20, which activates an internal mechanism to deliver a golf ball through chute 21. The player also selects a scorecard and pencil from rack 22, and a club from rack 23, and proceeds to play the mini-golf game through holes 1 through 9. Coins and/or bills may be later removed from coin door 24 by the owner of the unit.

FIGS. 3 and 4 show raised channels 15 of the target area 14 which capture the ball to feed it into one of the several holes 25, which activates the ticket dispenser 17 to dispense a corresponding number of redemption coupons won by the player.

Figure 5A:
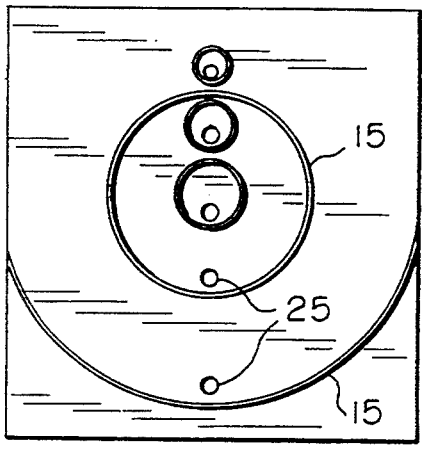
FIGS. 5A, 5B, 5C, and 5D show several target types any of which may be used in the invention.
Figure 5B:
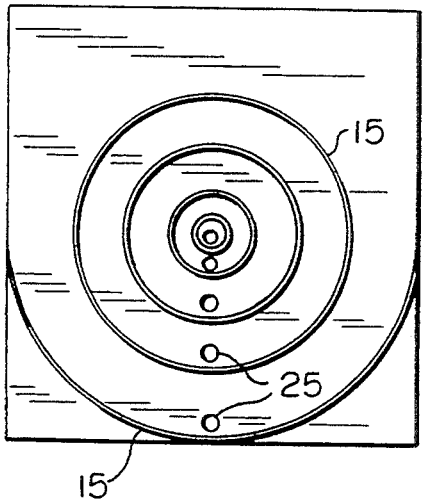
Figure 5C:
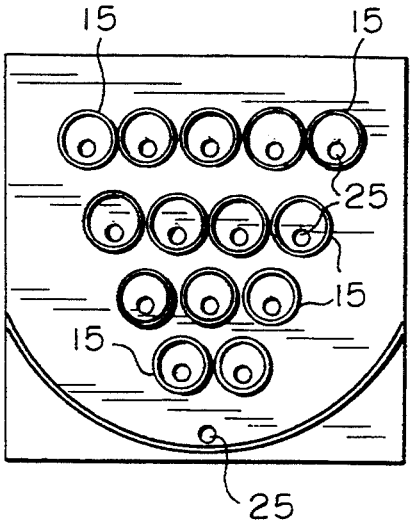
Figure 5D:
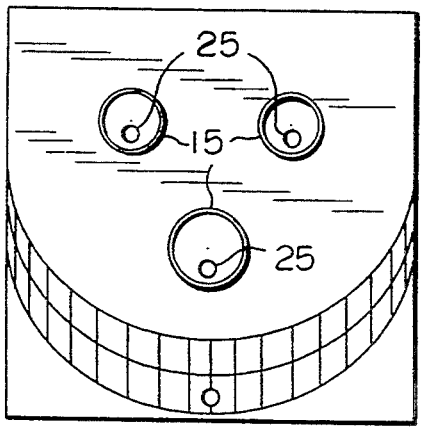

FIGS. 5A, 5B, 5C and 5D show several of the many possible target areas which may be used in this game. In each case, the target employs a set of raised channels 15, which direct the captured ball into a hole 25 in the target for delivery to the enclosed mechanism which triggers the appropriate selection of coupons to be dispensed. Shown in FIG. 5A is the preferred target; FIG. 5B is a bullseye target; FIG. 5C is a clown-face target; and FIG. 5D is a bowling pin target.

Figure 6:
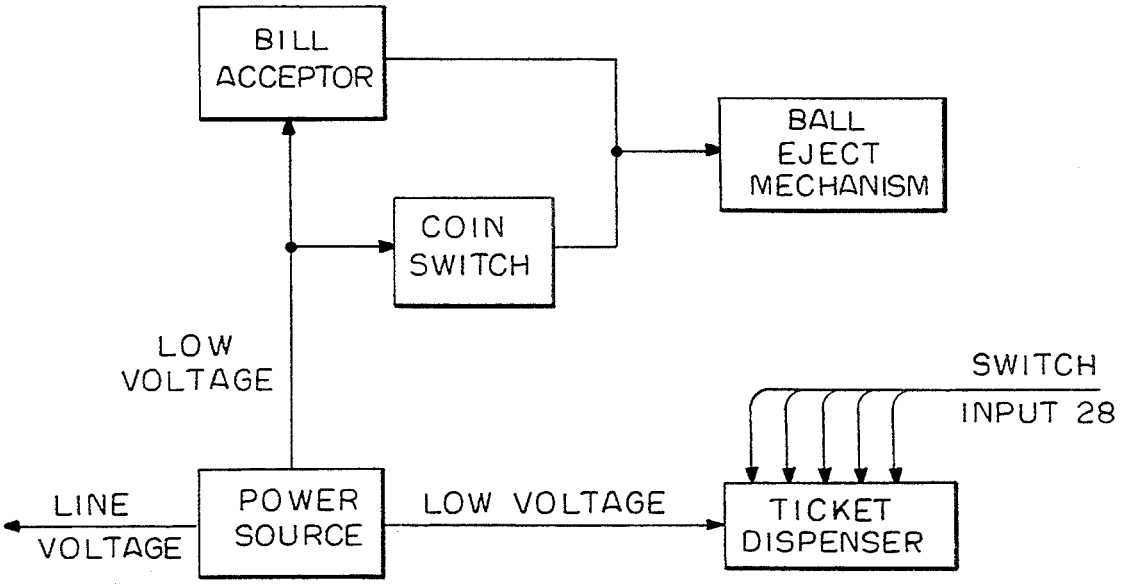
FIG. 6 is a schematic showing a wiring diagram of the electrical and electronic parts for the golf-ball dispenser and last hole unit shown in FIGS. 2, 3 and 4.

The electronic/electrical inter-connections of the invention are shown in FIG. 6. A power source 35 which can be either battery or line voltage supplied, provides power to the bill acceptor 20 to the ball eject mechanism 31, or a coin switch to operate the ball eject mechanism 31. The ball eject mechanism 31 may be a plunger-type coil which, when energized pushes the ball out to the delivery tube, or it may be any other type delivery means. The power source 35 also supplies the ticket dispenser 36 which supplies redemption coupons, determined in quantity by the activation of one of several target hole input switches 28.

Figure 7:
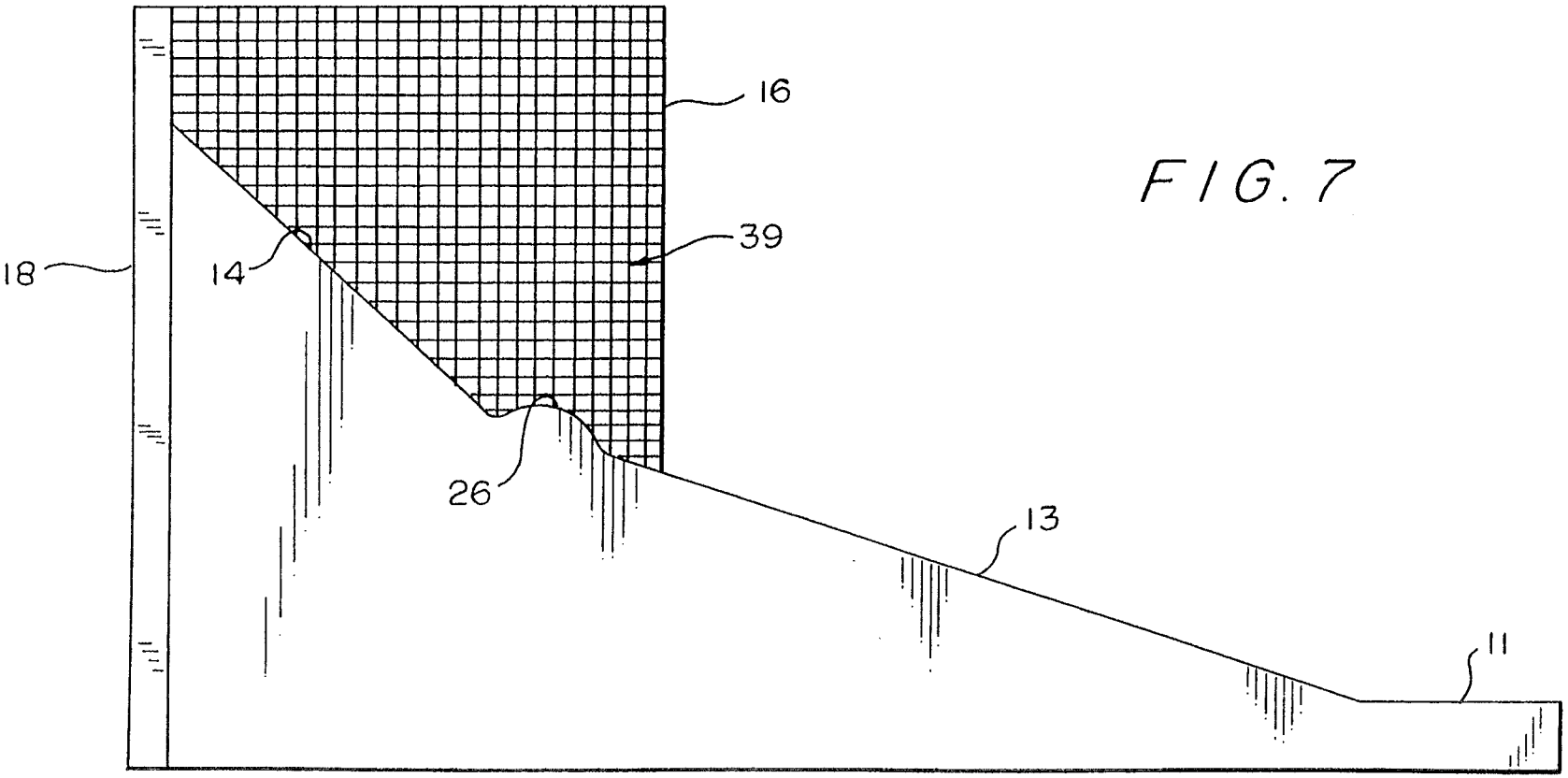
FIG. 7 is an elevation side view of the invention showing the ramp and target areas, and the restraining screening of the golf ball dispenser and last hole unit of FIGS. 2, 3 and 4.

FIG. 7 shows an elevation side view of the final hole unit showing the relative positions of the tee area 12, ramp 13, target are 14, screening frame 16, rear panel 18 where coin or currency inputs (19, 20), scorecard, pencil and club racks (22, 23) and ball dispenser 21 are mounted. Also shown is a hump 26 on ramp 13 at its elevated end which causes the putted ball to become airborne over the target 14 to allow it to fall into one of the several target channels and thence into a target hole 25.

Figure 8:
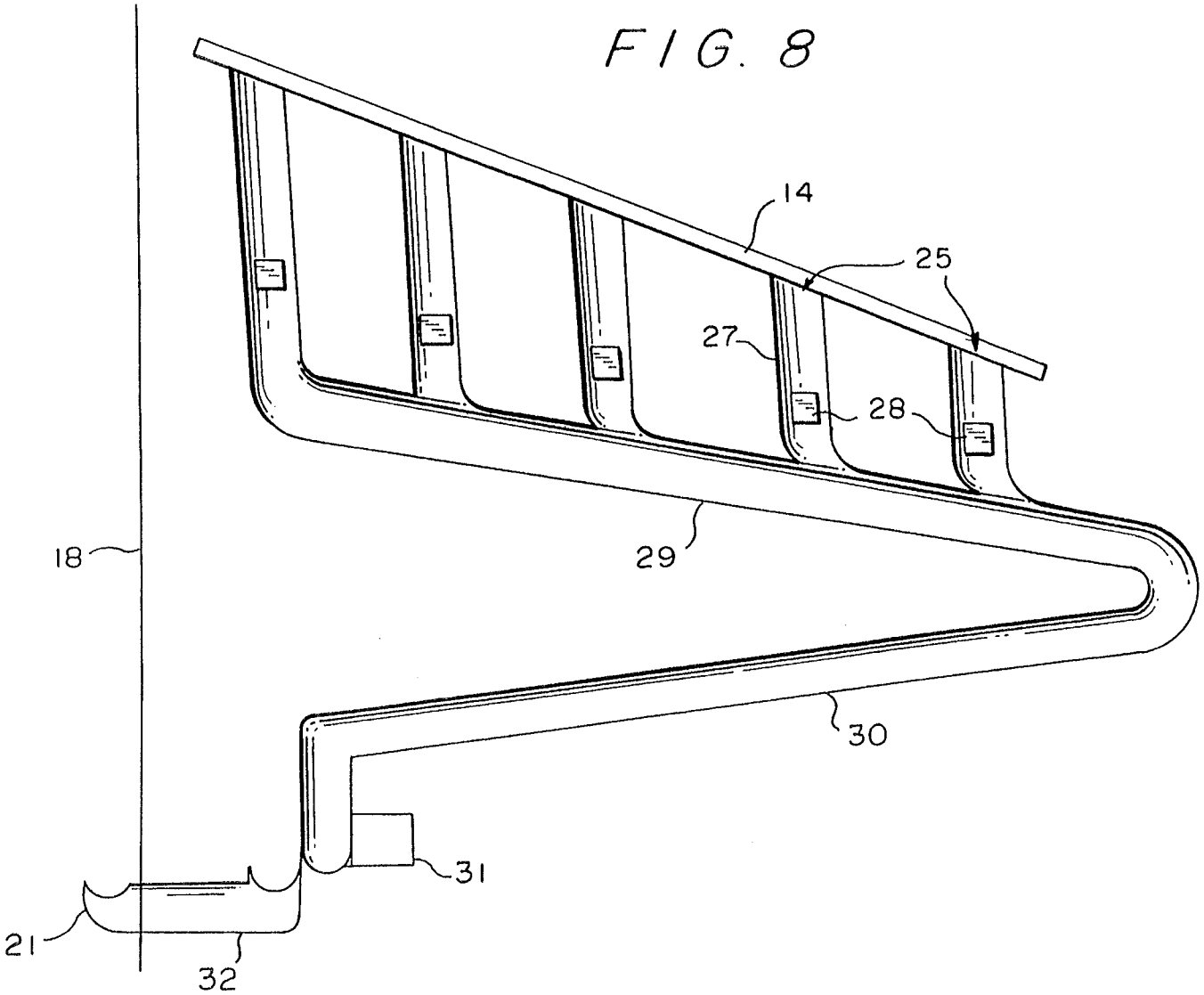
FIG. 8 is a cutaway side view of the interconnection of the tubes beneath the target, the scoring switches, the ball ejector, and the ball delivery tubes.

FIG. 8 is a cutaway side view of the internal tubing arrangement which collects the ball as it fall through a target hole 25 in target 14. The tube 27, through which the ball falls, activates switch 28, signalling the ticket dispenser 36 to dispense the requisite number of coupons. The ball then travels downward through delivery tube 29 into collection tube 30, each of which is slanted to take advantage of gravity to collect the balls played. Shown also is the ball eject mechanism 31, internal ball delivery tube 32, and external delivery tube 21 mounted on the front panel 18 of unit 10 of the mini-golf course.

Figure 9:
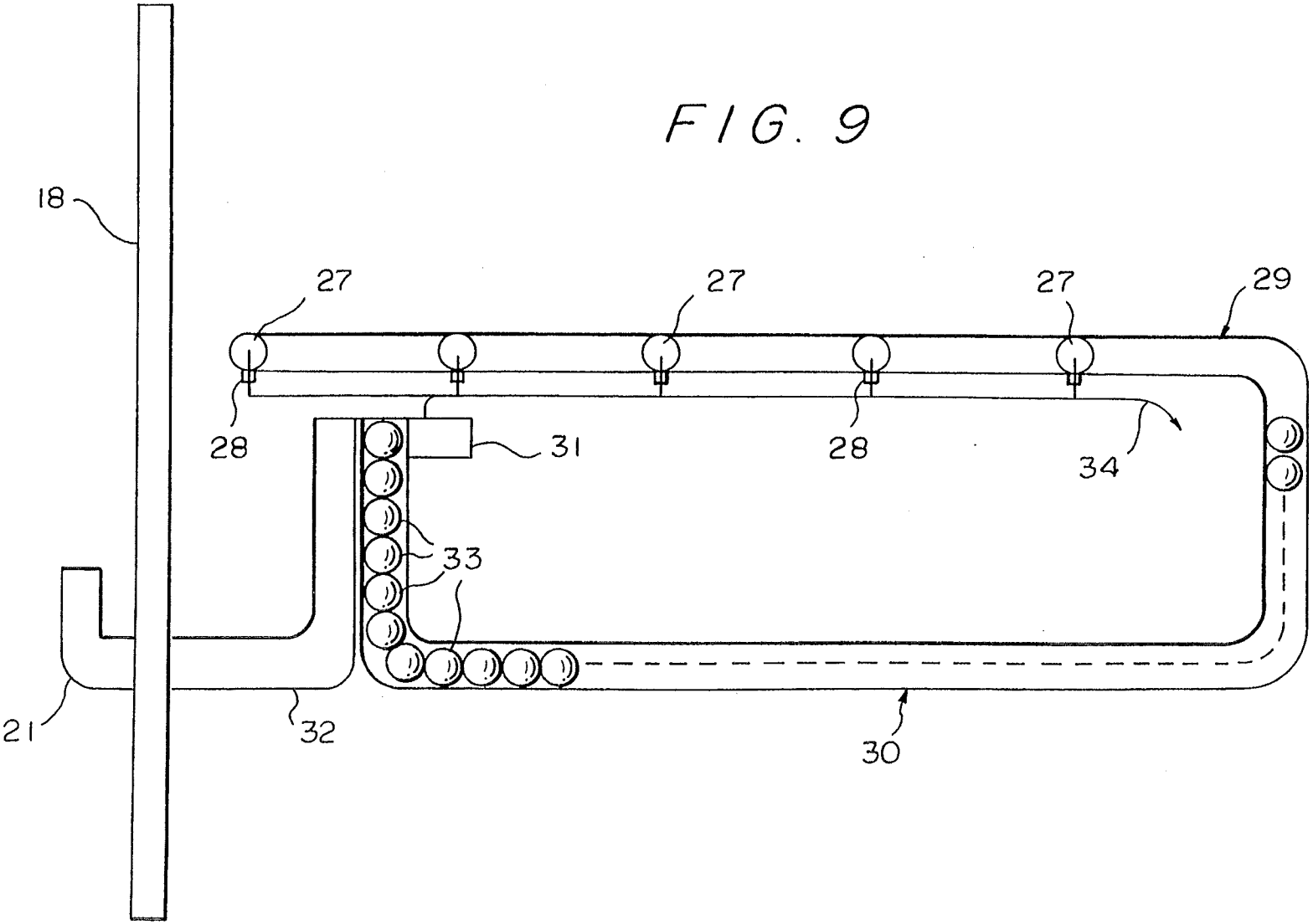
FIG. 9 is a top view of the tubes of FIG. 8, also showing the plurality of golf balls stored in the invention.

FIG. 9 shows a top view of the internal tubing arrangement. The ball falling through tube 27 activates the switch 28 to signal the ticket dispenser. Delivery tube 29 and collection tube 30 are long enough to collect as many golf balls 33 as are necessary to facilitate the largest possible number of simultaneous players on the mini-golf course. Ball eject mechanism 31, internal ball delivery tube 32, external ball delivery tube 21 and rear unit panel 18 are also shown on the Figure in their relative locations.

Figure 10:
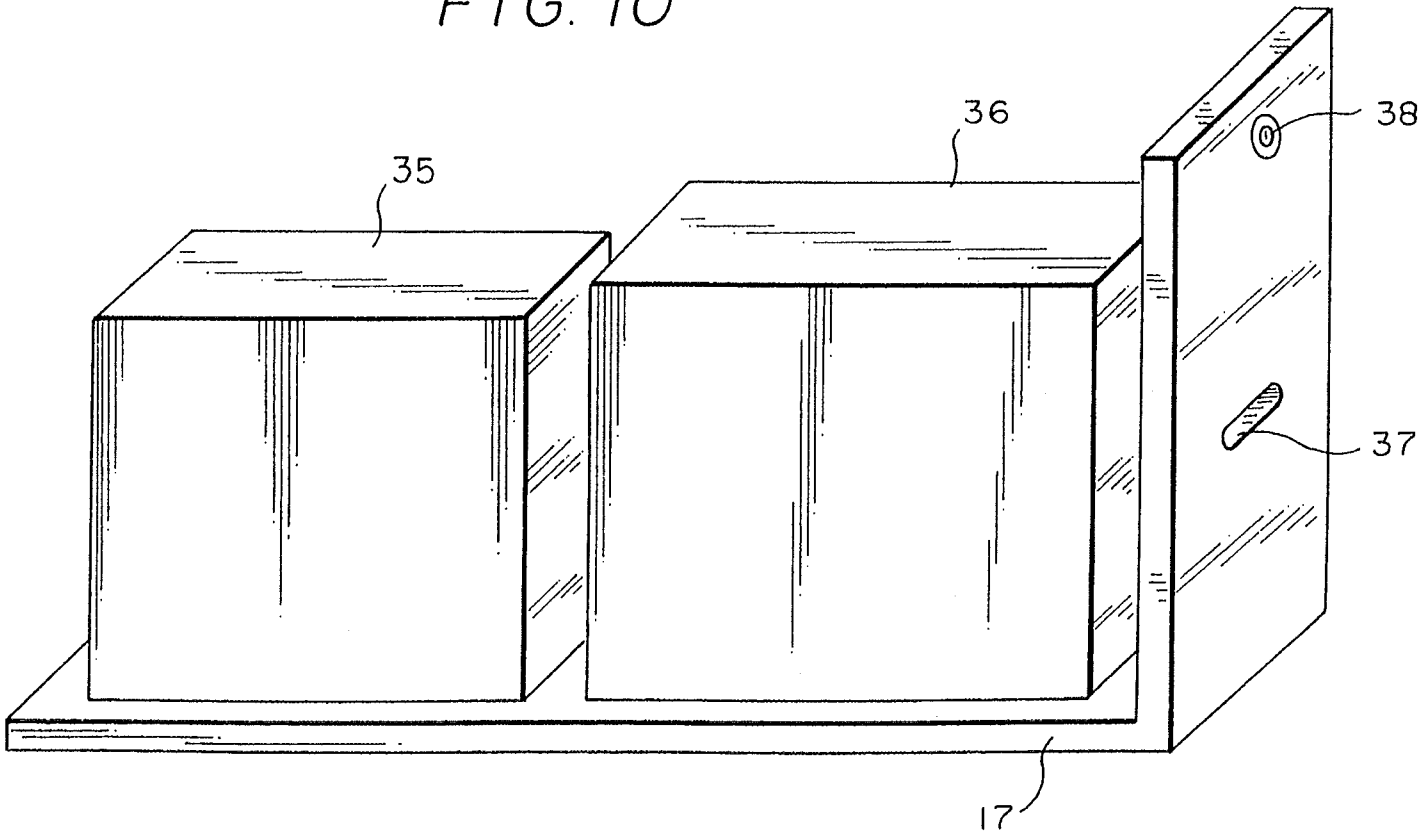
FIG. 10 shows the slide-out tray of the golf dispenser and last hole unit of FIGS. 2, 3 and 4 containing the redemption coupon ticket dispenser and the battery or power supply.

FIG. 10 shows the lockable ticket dispenser tray 17 shown in FIGS. 3 and 4 built into unit 10 of the final mini-golf hole. The cabling from ball ejector 31 and target hole tube switches 28 enters the tray through the battery or power supply 35 to ticket dispenser 36. Redemption coupons are delivered to the player through slot 37. The entire tray is locked into the body of the unit by lock 38.

While a particular embodiment of the invention has been illustrated and described in detail in the drawings and foregoing description, it is to be understood that this description is made one by way of example and not as a limitation to the scope of the invention which is claimed below.

What is claimed:

1. An automated mini-golf game comprising:

a plurality of mini-golf holes each having a tee area, a fairway or putting green and at least one target hole, a combination ball dispenser and final hole unit located at a final mini-golf hole of said plurality of mini-golf holes, said combination ball dispenser and final mini-golf hole unit having;

a housing and coin and bill acceptor means on said housing for delivering a golf ball to a player when actuated, means in said housing for retaining a plurality of golf balls for delivery to a player when said coin and bill acceptor means is actuated to deliver a golf ball, a ramp on said housing extending from an end of said fairway or putting green, said ramp having a hump to loft a putted golf ball, a target area on said housing at an elevated end of said ramp having a plurality of target holes which permit return of putted golf balls to said means for retaining golf balls, switch and dispensing means in said housing for identifying a target hole of said plurality of target holes through which a golf ball has been putted and for thereafter dispensing redemption coupons corresponding to said target hole, a set of racks on said housing to hold scorecards, pencils and golf clubs, to allow an entire game to be played sequentially by a multitude of players without an on-site attendant, and a lockable collections means in said housing for collecting coins and currency expended to play said mini-golf game.

2. The mini-golf game according to claim 1, wherein said final mini-golf hole is closer to said tee area of a first mini-golf hole than any other said tee area of said plurality of mini-golf holes.

* * * * *